US005338033A

United States Patent [19]

Nunez Serrano

[11] Patent Number: 5,338,033

[45] Date of Patent: Aug. 16, 1994

[54] DIDACTIC PUZZLE GAME

[75] Inventor: Guillermo Nunez Serrano, Almonaster la Real, Spain

[73] Assignee: SIMCO, S.A., Sevilla, Spain; a part interest

[21] Appl. No.: 961,174

[22] Filed: Oct. 14, 1992

[30] Foreign Application Priority Data

Oct. 14, 1991 [ES] Spain ..... 9102264

[51] Int. Cl.[5] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 4,427,197 | 1/1984 | Doose | 273/153 S |
| 4,441,715 | 4/1984 | Titus | 273/153 S |
| 4,496,155 | 1/1985 | Goldfarb | 273/153 S |
| 4,593,908 | 6/1986 | Ibrahim | 273/153 S |

FOREIGN PATENT DOCUMENTS

| | | | |
|---|---|---|---|
| 2593075 | 7/1987 | France | 273/153 S |
| 266007 | 4/1981 | Spain . | |
| 260185 | 8/1981 | Spain . | |
| 260186 | 8/1981 | Spain . | |
| 261408 | 10/1981 | Spain . | |
| 261732 | 11/1981 | Spain . | |
| 262101 | 11/1981 | Spain . | |
| 263457 | 12/1981 | Spain . | |
| 273317 | 2/1982 | Spain . | |
| 263903 | 3/1982 | Spain . | |
| 263961 | 3/1982 | Spain . | |
| 264404 | 3/1982 | Spain . | |
| 266798 | 7/1982 | Spain . | |
| 102481 | 9/1982 | Spain . | |
| 8500077 | 1/1985 | Spain . | |
| 292405 | 2/1986 | Spain . | |
| 2012542 | 8/1988 | Spain . | |
| 1008156 | 10/1988 | Spain . | |
| 122597 | 7/1990 | Spain . | |
| 1014725 | 7/1990 | Spain . | |
| 1014988 | 8/1990 | Spain . | |
| 1015187 | 9/1990 | Spain . | |
| 1512641 | 10/1989 | U.S.S.R. | 273/153 S |
| 1530191 | 12/1989 | U.S.S.R. | 273/153 S |

*Primary Examiner*—V. Millin
*Assistant Examiner*—Steven B. Wong
*Attorney, Agent, or Firm*—Darby & Darby

[57] ABSTRACT

A puzzle game has the shape of a sphere which is made up of eight parts or octants which can be moved around the three perpendicular shafts of coordinates, changing the relative position between one and the other to correctly try and form the spherical surface with the motif engraved on the octants. The eight octants are joined in a mobile way to an inner part which is defined by a small sphere with six cylindrical arms arranged according to the shafts of coordinates and finished on trunci-conical flareouts. On their three flat sides, the octants present a machining with center in the sphere which causes the formation of channels which allow the pass of the radial arms of the inner part and also its two trunci-conical flareouts. To overcome the obstacle of the small sphere of the inner part, the vertex of the octants have a machining which determines a spherical emplacement mark. Interconnection between the different parts is exclusively achieved by precision in the machining and by a flexible fit, without any auxiliary fixture elements intervening. One of the octants has no movement in respect of the arms of the inner part, which coincide with the edges of that octant.

2 Claims, 2 Drawing Sheets

DIDACTIC PUZZLE GAME

FIELD OF THE INVENTION

The present invention relates to a didactic puzzle game and offers a number of relevant and advantageous features compared with those which are available today on the market of its kind.

BACKGROUND OF THE INVENTION

Puzzle game devices are known today whose component parts can be moved in space in the form that has been mentioned above, adopting on the outside both a cubic shape and a spherical shape. The number of parts or elements which form the device varies widely, and in some cases it may be formed by eight parts and in others by a notably larger number. In the case of cube-shape puzzles, each of their sides can be formed with those corresponding to four, nine, sixteen, etc., small size cube elements or dice.

There are also puzzles whose outside shape determines a polyhedron of the type formed by a plurality of triangular sides, such as an icosahedron. In other cases, the parts are independent and can fit together to form a ball whose outside area is determined by the grouping or hexagonal and pentagonal shapes in the known form.

In these cases which show a structure that is more similar to the didactic game of the puzzle which the invention proposes, the parts which form it can be moved around in space and present a complex structure to keep these parts together, and normally springs and screws intervene, at least for part of their pieces.

The parts which form a puzzle in accordance with the present invention and with which a sphere is composed, can be moved around in the space between the three shafts of coordinates. Each part forms an octant of the sphere which may occupy any position in respect of the rest.

The purpose of this invention is that these parts are located around an inner part which has arms arranged in correspondence with the shafts of these coordinates, and they are kept grouped together only by the fit of their forms and counter-forms and without any fixture screw or similar part intervening.

In general lines and to achieve the advantageous features which are proposed, and at the same time eliminate the setbacks which similar devices offer today, the didactic puzzle game which forms the object of this invention is made up of eight parts which are connected to an inner part and fit perfectly by pressure and are retained so that they cannot become accidentally separated, for which only the flexibility of the material which forms them intervenes, and also the geometric shape and perfect machining of forms and counter-forms established between the adjacent components.

Since the eight parts define respective octants of a sphere and they must be able to move around in space in the known form on the three perpendicular shafts, the puzzle in question includes like others of its kind, an inner component materialized by a small sphere from which six cylindrical arms depart, arranged according to these shafts, finished off in conical or trunci-conical flareouts.

Each of the outer mobile parts which we will in future call octants, have a spherical machining on the vertex, to rest against the spherical surface of the small central sphere, in the free zones of the six cylindrical arms. On the outside, the side faces of these octants surpass the length of the arms, including the tops or their ends, where the three sides have arched offsets or channels where the tapered ends of the arms play, and consequently the depth of these channels has the same gradient as the distance of the conical shape of the end finishes.

The more internal area in respect of these curved channels where the tapered ends of the arms can move, shows a parallel off-phase in respect of the outer part, in a magnitude which is equivalent to half the diameter of these arms, so that these can thus be moved by the annular chambers that are formed inside. According to this, once the sphere is formed, the portions which are radially more distant from the areas which are in contact with two contiguous octants, establish mutual support, whilst the remaining area is distant from that of the contiguous octant according to a diametric section which recalls an arrow-shape, thus adjusting itself to the arm and flare finish of same.

Thus, each octant rests on three conical ends, three arms and on the small central sphere.

The spherical area of each of the eight octants has part of the surface of the globe sketched on it preferably in a maritime shipping chart. It is moreover foreseen that the octants have another spherical methacrylate surface attached or adhered, to protect the engraved motif.

The eight octants, which are related with one another by the central part, leave a space or channel between them according to the surfaces described, permitting a relative displacement of the arms with their conical or trunci-conical ends. Each octant therefore has three degrees of freedom to rotate in a horizontal, vertical and in another vertical plane perpendicular to the previous one, namely, around the three perpendicular shafts, such that each octant can thus occupy the position corresponding to any other one of them. Since the outside area of the sphere must faithfully reflect the motif represented in it, for example, the maritime shipping chart, the game consists in forming it correctly when it is out of place.

To fix the correct relative position between the interior part and the octants, thus permitting a turning movement around any of the perpendicular shafts, without there being any problem as consequence of a possible blocking when it turns on any of these perpendicular shafts, one of the octants is deprived of movement in respect of the inner part. According to this, three of the arms of the inner part are located in the respective edges of the octant, that is to say, this latter is located in the quadrant defined by three of the arms of the inner part. This immobilization which can however be achieved by gluing, is preferably obtained because there are bosses on either side and in a position contiguous to the arms to thus prevent the movement of latter.

To facilitate an understanding of the characteristics of the invention and forming an integral part of this descriptive report, sheets of drawings are attached whose figures, in an illustrative but not a restrictive manner, have represented the following:

DETAILED DESCRIPTION OF THE PREFERRED EMBODIMENT

Figure 3:
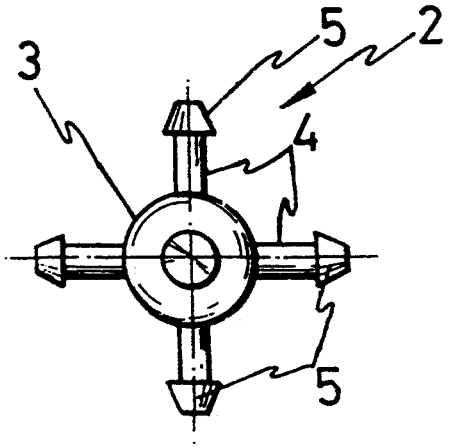
FIG. 3 is a view of the central inner part which defines the inter-connection element with the octants, from a point located in one of its shafts.
Figure 4:
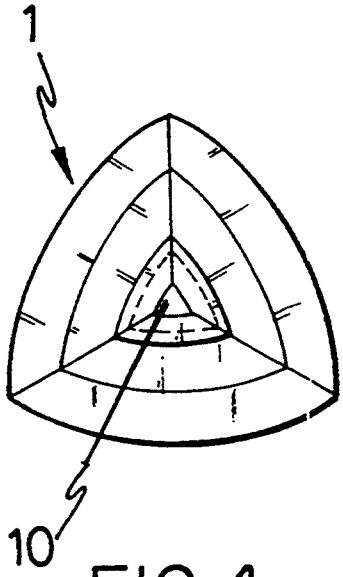
FIG. 4 is a plan-view of one of the octants, considered resting on its spherical area.

With reference to the numeration adopted in the figures, we can see how the didactic puzzle game, which the invention proposes, adopts the shape of a sphere and is made up of eight parts which can be moved in the space around the three shafts of coordinates, each of them consequently having the primary shape of an octant. Each of these parts or octants which on the outside form the sphere, has been referenced as number 1 and are grouped by the inner part shown in FIG. 3 and referenced in general with number 2.

The inner part 2 is made up of a small inner sphere 3 with six arms 4 arranged according to the three shafts of coordinates and in both directions. Each of the radial arms 4 is finished off with a trunci-conical flareout 5, in this example of execution that is shown.

Figure 5:
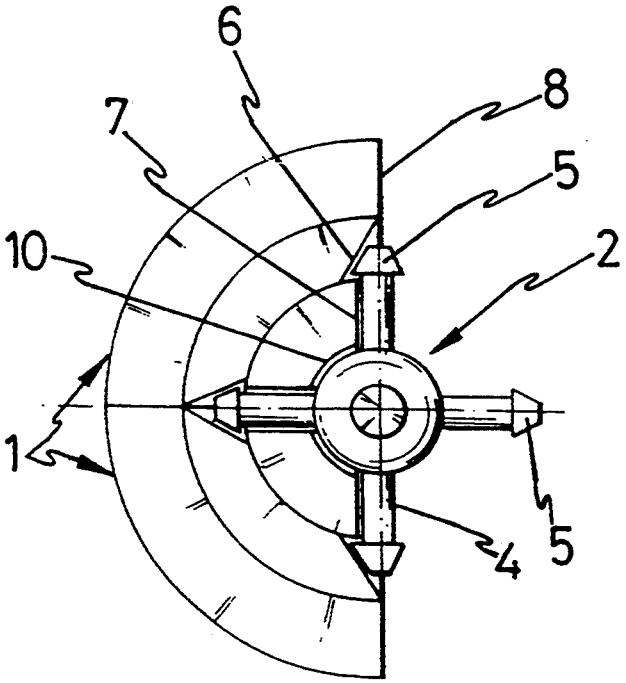
FIG. 5 is a similar view as FIG. 3, including two octants of the sphere, specifically those located at the rear and left-hand side of the vertical plane of symmetry.

Each of the octants 1 has on each of their flat sides a curved groove 6. The curved grooves 6 are formed concentric with the center of the sphere. The cross-sectional shape of the grooves 6 is sloped similar to the slope of the trunci-conical ends 5 of the arms 4. The radially inner edge of the grooves is formed by section 7 of the octants 1. The sections 7 follow the arc formed by the moving arms 4, thus allowing the arms 4 and specifically, their ends 5, to travel in the grooves 6 formed between the octants 1 off-phase in respect of the more external portion of the circular crown 8 of the flat side corresponding to octant 1 considered. The area corresponding to section 7 of the profile of the machined channel, is also flat and is tucked in respect of the outside zone 8 in a magnitude corresponding approximately to the value of the radius of arm 4. Between the trunci-conical area corresponding to section 6 of the profile and section 7 of same, a supporting area 9 is formed for the tiers of the trunci-conical finish 5 in respect of the external periphery of the respective radial arm 4, as can be readily deduced from observing FIG. 5.

Naturally to permit the insertion of the inner part 2, due precisely to the presence of the small sphere 3, each of the octants 1 have their vertex blunted, according to a spherical mark 10 preferably of seating for sphere 3.

The eight parts 1, or octants 1, are joined by the interior part 2 and there is the possibility of a relative turn between a semi-sphere and its opposing one, around any of the shafts of coordinates, materialized by arms 4 and trunci-conical finishes 5 which are aligned.

Considering that in the manufacture of the component parts there are very precise machining tolerances, the insertion of octants 1 around the central inner part 2 is made in a very precise manner to prevent any pitching in the relative movement of octants 1. The assembly is made without any other additional component, such as screws, springs, etc., which is initiated gently, logically and inserting the last part by a gentle pressure to overcome the flexible resistance of the actual material which forms the components, where the readjustments in machining tolerances collaborate. Once the spherical unit has been formed, it is impossible to dismount it, unless a destructive outside effort is exerted.

Figure 1:
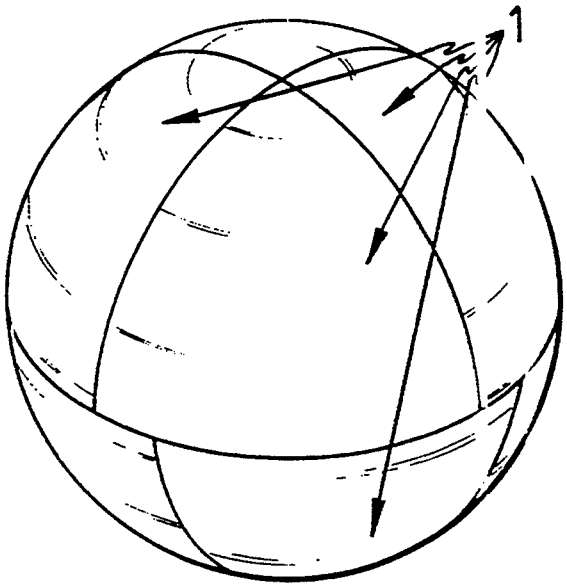
FIG. 1 is a perspective view which schematically shows the didactic puzzle game, in a position where the parts which form it are turned slightly in respect of the vertical axle.
Figure 2:
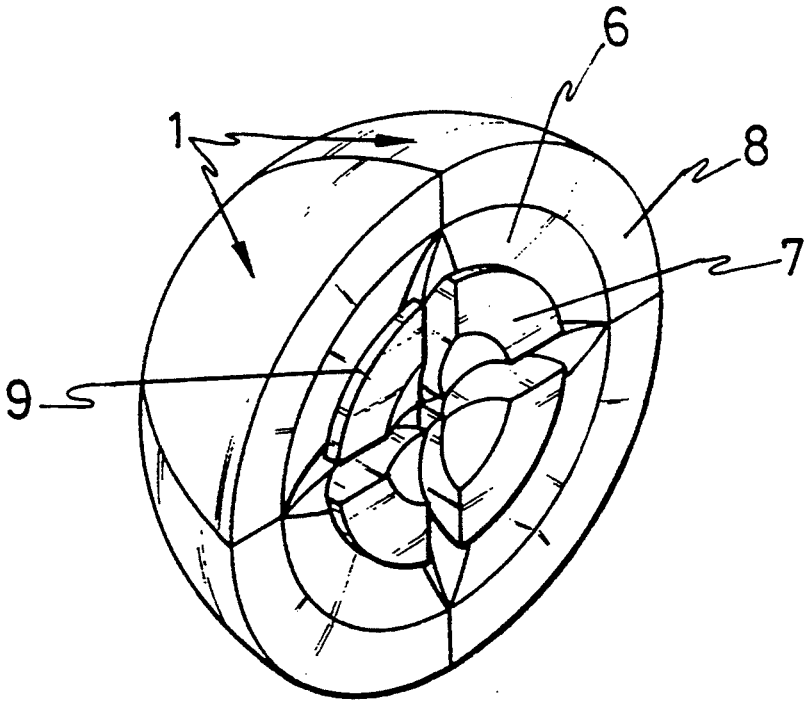
FIG. 2 is a perspective view of half the sphere to clearly observe the machined channels to permit the relative spin in respect of the other half of the sphere, which can be made around any of the three perpendicular shafts.

In FIG. 2 we can see how it is possible to accurately place in the cross channels or empty inner spaces between octants 1, four of the radial coplanar arms 4 of the inner part 2, once the radial arm 4 has been fitted which occupies a perpendicular position to the circular area of the semi-sphere.

Figure 6:
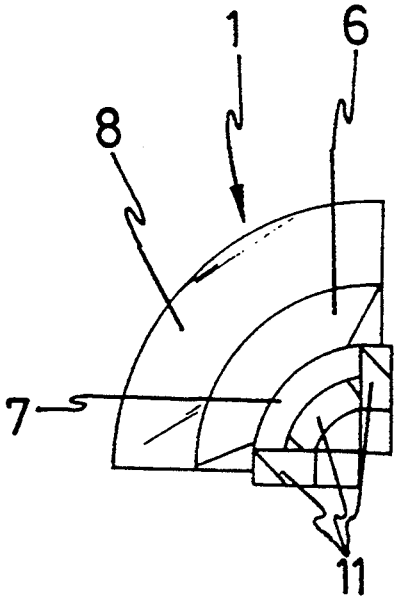
FIG. 6 shows an elevational view of the octant which maintains the relative correct position of the inner part defined by the small sphere which contains the six radial arms.

If the radial arms 4 become offset with respect to the grooves 6 between adjacent octants 1, it is possible that turning some of the octants 1 will be impeded. To prevent this, one of the octants 1 includes raised bosses 11 on its three flat sides (see FIG. 6). These bosses are formed on the section 7 and prevent an arm 4 from rotating past them. As the puzzle is rotated, the bosses will therefore maintain all of the arms 4 in positions with respect to the octants where they may easily enter the grooves formed between octants 1. When a spin occurs around any of the shafts of coordinates, upon a hemisphere turning in respect of the other one, and the lines of separation of the different octants 1 are coplanarily arranged, this assures that all the radial arms 4 remain in the same relative position compared with any of the octants 1 than the position which they hold in respect of octant 1 to which they are tightly secured.

I claim:

1. An improvement in a didactic spherical puzzle having eight blocks interconnected together to permit rotatation of any four of them with respect to the other four along each of three orthogonal axes passing through a center of the puzzle, said puzzle also having an inner part defined by an inner sphere from which six radially extended arms depart in the direction of said orthogonal axes, said improvement comprising;

an enlarged head formed at a radially outward end of each of said arms, each of said heads having a truncated cone shape with a flat base of each of said truncated cone shaped heads being directed toward the center of said sphere;

each of said blocks comprising;

an outer spherical surface;

an inner spherical surface, opposite to said first surface, and having a diameter corresponding to said inner sphere;

three sides joining said first and second spherical surfaces, each of said sides having a groove to allow the movement of said heads and their corresponding arms between two confronting faces of said blocks, said heads moving within said grooves, said grooves each having a flat surface adjacent said flat bases;

wherein one of said blocks has bosses in the respective grooves to restrict the movement of said arms.

2. An improvement in a didactic spherical puzzle according to claim 1, wherein said first spherical surface is covered with a transparent plastic layer.

* * * * *